United States Patent [19]

Knorreck

[11] 4,318,379

[45] Mar. 9, 1982

[54] CONTROL APPARATUS FOR A FUEL INJECTION PUMP FOR DIESEL COMBUSTION ENGINES

[75] Inventor: Peter Knorreck, Weissach, Fed. Rep. of Germany

[73] Assignee: Robert Bosch GmbH, Stuttgart, Fed. Rep. of Germany

[21] Appl. No.: 81,287

[22] Filed: Oct. 2, 1979

[30] Foreign Application Priority Data

Nov. 7, 1978 [DE] Fed. Rep. of Germany ..... 2848232

[51] Int. Cl.[3] ..... F02D 7/00

[52] U.S. Cl. ..... 123/387; 123/198 DB

[58] Field of Search ..... 123/387, 386, 385, 379, 123/499, 497, 198 DB, 198 D, 198 B

[56] References Cited

U.S. PATENT DOCUMENTS

| | | | |
|---|---|---|---|
| 3,025,843 | 3/1962 | Wagner et al. | 123/198 DB |
| 3,605,711 | 9/1971 | Fuso | 123/198 D |
| 3,614,946 | 10/1971 | Staudt et al. | 123/387 |
| 3,782,493 | 1/1974 | Lipschutz et al. | 123/198 D |
| 4,170,976 | 10/1979 | Eckert et al. | 123/387 |
| 4,208,998 | 6/1980 | Hofmann et al. | 123/198 DB |

FOREIGN PATENT DOCUMENTS

| | | | |
|---|---|---|---|
| 651036 | 10/1962 | Canada | 123/198 DB |
| 1299678 | 12/1972 | United Kingdom | 123/198 DB |

*Primary Examiner*—Ira S. Lazarus
*Assistant Examiner*—Magdalen Moy
*Attorney, Agent, or Firm*—Edwin E. Greigg

[57] ABSTRACT

A control apparatus for a fuel injection pump of a diesel combustion engine is proposed, in which the fuel delivery adjustment element of the injection pump is moved to its zero adjustment position when the engine cuts off, is held in this position (roll-start lock), and can reach its start-position only in accordance with standard starting procedure. The control apparatus includes a hydraulically actuated correcting element, that can be placed under fuel delivery pump pressure by means of a directional control valve for displacing the fuel delivery adjustment element into its zero adjustment position. The correcting element is locked by a slide lock, likewise controlled by delivery pump pressure. The slide lock is brought into its blocking position when the delivery pump pressure drops sufficiently, and retracted only when the driver actuates the directional control valve and the delivery pump pressure increases when the engine starts.

3 Claims, 3 Drawing Figures

CONTROL APPARATUS FOR A FUEL INJECTION PUMP FOR DIESEL COMBUSTION ENGINES

BACKGROUND OF THE INVENTION

The invention relates to a control apparatus for a fuel injection pump of a diesel combustion engine. The apparatus includes a correcting element actuated under delivery pump pressure to stop the injection pump by means of a directional valve, and to move the fuel delivery adjustment element of a fuel injection pump to its zero adjustment position. When not under pressure, the correcting element is moved under the influence of a return force into a lock position. The apparatus also includes a lock slide which is arranged perpendicular to the longitudinal axis of the correcting element, and is actuated to delimit the path of the correcting element.

Such an apparatus is disclosed in DE-OS No. 27 13 805 German laid-open application. In the known apparatus, the correcting element, which is under pressure from the fuel flow returning from the injection pump, and is blocked by a magnetic valve, displaces a fuel delivery adjustment member to its zero adjustment position from the momentarily assumed drive position in the direction of a stoppage of the injection pump. This apparatus constitutes not only a safety apparatus for the engine, but also serves as an anti-theft device, a so-called "roll-start-lock." If the vehicle is broken into and moved without activation of the service member, or if the vehicle begins to roll, the fuel then delivered by the delivery pump presses the correcting element immediately into the position in which the fuel delivery adjustment member is at its zero adjustment position. This is supposed to prevent starting of the engine without engaging the electrical apparatus. Since during extended idling of the engine, and during decreasing fuel pressure, the correcting element can, however, reach the start position by means of the return devices, there is the danger that during undesired rolling, the engine would start for a short time, only then, as described, to turn itself off. This known control apparatus then does not fulfill completely the particularly strict safety requirements. A lock slide positioned at a right angle to the longitudinal axis of the correcting element serves purely as a full- or partial-load stop, and is not in contact with the correcting member when the injection pump is stopped.

OBJECT AND SUMMARY OF THE INVENTION

It is a principal object of the invention to improve the known apparatus as described above so that a secure locking condition is achieved.

The control apparatus in accordance with the invention has the advantage over the known art that the fuel delivery adjustment member of the injection pump displaced by the correcting element into the stop-position is held in this stop-position by the lock slide so as to insure an absolutely certain roll-start lock. Only when the driver actuates the directional control valve or when the engine is running is the lock released and the correcting member can reach the start position which clears the way for the fuel delivery adjustment member.

In the known control apparatus disclosed in the above noted De-OS No. 27 13 805, a directional control valve is actuated by an electromagnet, which effects the inflow of the hydraulic medium to the correcting element when the electromagnet is de-energized and the outflow of the hydraulic medium to a pressureless chamber when the electromagnet is energized. With the present invention, the use of hydraulic pressure source is made possible by the features noted herein. Thus, the control apparatus can be connected, for example, to the engine oil circuit.

If, for example, the fuel delivered from a delivery pump which supplies the fuel injection pump is used as a hydraulic medium, as in the above noted DE-OS No. 27 13 805, then, with little expenditure, locking of the adjusting piston in its stop-position can be achieved by other features noted herein. Due to other features recited, an assembly for the control apparatus which is sufficiently simple and compact and with few construction parts is possible.

In the above cited known control apparatus, the adjusting piston is positioned at the correcting element, in whose surface a recess, shaped like the stopping shoulder for the lock slide, is formed. With the present invention, this construction is improved in that there is less susceptibility to waste oil because of the features recited, since the surface between the annular groove and the pressure chamber can be equipped with a piston ring, and the path of the lock slide never reaches direct connection with the pressure chamber which is exposed to fuel pump pressure.

It is particularly advantageous when the lock slide is shaped in accordance with the features recited herein.

BRIEF DESCRIPTION OF THE DRAWINGS

Three preferred embodiments are described below.

DESCRIPTION OF THE PREFERRED EMBODIMENTS

Figure 1:
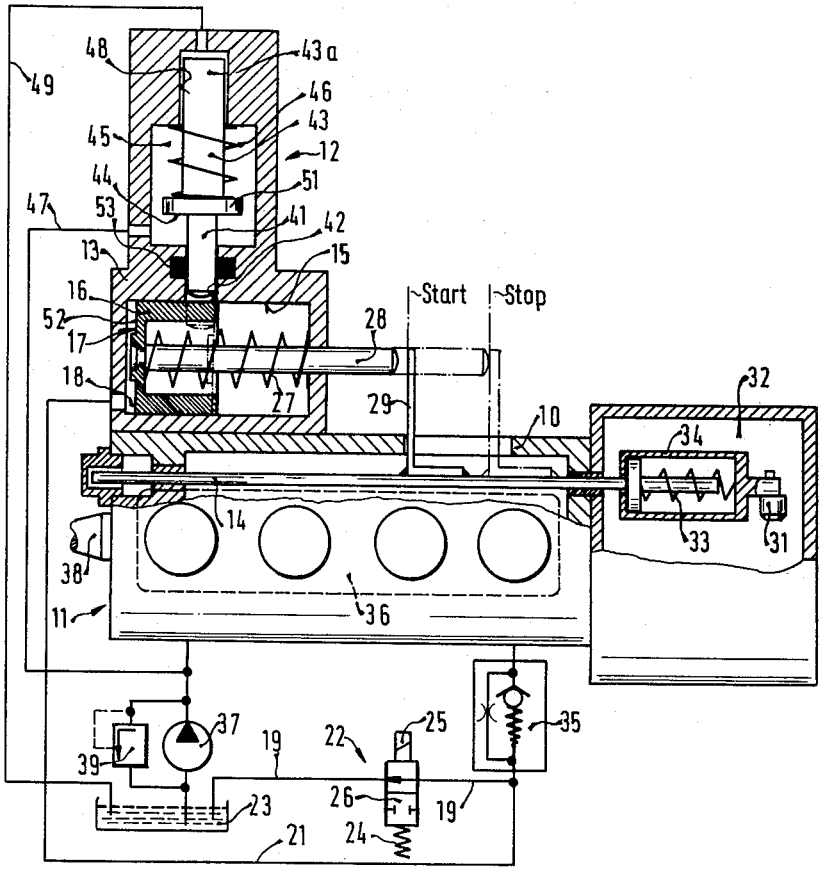
FIG. 1 illustrates a simplified partial cross sectional view of a first preferred embodiment of the invention wherein the control apparatus of the injection pump is mounted to the injection pump.

The preferred embodiment illustrated in FIG. 1 illustrates a control apparatus 12 mounted on the housing 10 of an injection pump 11. A housing 13 of this control apparatus 12 contains an adjusting piston 16 of a correcting element 17 in a cylinder bore 15. The cylinder bore 15 is positioned parallel to the longitudinal axis of an actuating rod 14 that serves as a fuel delivery adjustment member of the injection pump. The adjusting piston 16 is positioned, in an oil-tight manner, in the cylinder bore 15, and serves as a movable wall of a pressure chamber 18 shaped by a part of the cylinder bore 15. The pressure chamber 18 is expanded by the pressure of the fuel which serves as a hydraulic medium. The fuel flows to the pressure chamber 18 through a control duct 21. A return duct 19 is connected to the control duct 21 whenever a magnetic valve 22, connected to the return duct 19, is in an energized state, i.e., in the illustrated position, in which the return flow of fuel is delivered to a tank 23, depicted as a pressureless chamber.

The magnetic valve 22 comprises a 2/2-way directional control valve 26, which is moved by an electromagnet 25 against the force of a return spring 24. The directional control valve 26 is illustrated, in simplified form, and in the open position for the return flow of fuel to the tank 23 when the electromagnet 25 is energized. In this circuit position, the return duct 19, and along with it the control duct 21, as well as the pressure chamber 18 are pressure relieved, and a compression spring 27 displaces the correcting element 17 into the depicted starting position. In this starting position a regulating rod 28 which is fastened to the adjusting piston 16 of the correcting element 17 is displaced towards the left (FIG. 1) so that a bar 29, which serves as a transfer element on the actuating rod 14, along with the actuating rod 14 can reach the start position shown in solid lines, as indicated by the designation "Start". In this position, the actuating rod 14 is displaced during corresponding activation by a control lever 31 of a speed regulating device 32. Connected between the control lever 31 and the actuating rod 14 is a drag link 34 equipped with an alternate spring 33, which in a known manner, prevents overloading of the actuating rod, when the correcting element 17 of the control mechanism 12 displaces the actuating rod 14 in the "Stop" direction.

The return duct 19 and the control duct 21 are connected to the outlet side of an overflow, or pressure relief, valve 35, which controls the overflow of fuel out of a suction chamber 36 of the injection pump 11 to a tank 23. The fuel is drawn from the tank 23 by a fuel delivery pump 37. The fuel delivery pump 37 can be one which is driven mechanically by a cam shaft 38 of the injection pump 11, or is electrical, in which the fuel delivery is automatically controlled, or, as illustrated, one which is equipped with a pressure relief valve 39, which prevents an excess of pressure in the injection pump when the return flow in the return duct 19 is blocked.

Perpendicular to the longitudinal axis of the correcting element 17 in the wall of the housing 13 of the control apparatus 12, a lock slide 41 is positioned in a corresponding cross bore 42 to the cylinder bore 15. The lock slide 41 is depicted as a differential piston and is equipped with an extension 43 which has a greater diameter than that of the lock slide 41. Because of this difference in diameters a pressure shoulder 44 is formed, against which the pressure of the fuel in the work chamber 45 acts, and thereby moves the lock slide 41 opposite to the force of a return spring 46 into a release position removed from the path of the adjusting piston 16. The work chamber 45 is connected to the pressure source 37 via a duct 47. Since the work chamber 45 is to be subjected to the full pressure of the delivery pump 37, the duct 47 is connected, at some particularly well-suited place between the delivery pump 37 and the pressure relief valve 39. In practice, it is desirable to be able to connect the work chamber 45 directly to the suction chamber 36 of the injection pump 11, so that long duct paths are avoided. Thus the ducts depicted in FIG. 1 serve as a simplified illustration of the hydraulic connections; in practice there are partially contained within the mechanism. Thus, the delivery pump 37 with the appropriate pressure relief valve 39 are normally mounted on the injection pump 11.

An end 43*a* of the cylindrical extension 43 extends into a guide cylinder 48, which is formed as a blind bore intersecting the work chamber 45. The guide cylinder 48 is equipped with a relief duct 49 at its base, which leads to tank 23, or can be connected with another pressure-relieved chamber of the injection pump 11. In the region of the pressure shoulder 44 the lock slide 41 is equipped with a strip 51, which serves as a support for the return spring 46, the other end of which is placed against the housing 13 of the control apparatus 12.

The electromagnet 25 of the magnetic valve 22 is connected to the part of the electrical circuit which is active when the engine starts and while the engine is running. In case of an emergency, or in the event of a normal stopping of the engine, the electrical circuit is interrupted, and the return spring 24 of the magnetic valve 22 displaces the valve member of the 2/2-way directional control valve 26 into its blocking position, which blocks the return flow through the return flow duct 19. The fuel pressure which is locked in the control duct 21 and in the pressure chamber 18 displaces the adjusting piston 16 of the correcting element 17 to the right, and thus the regulating rod 28 is displaced to the right to the position indicated by the dot-dash lines in FIG. 1, against the force of the compression spring 27. In this position, the rod 29, and along with it, the actuating rod 14 of the injection pump 11 is displaced into the "Stop" position. When the adjusting piston 16 has reached this position, the injection pump 11 ceases delivery of fuel, and the engine operation ceases. The fuel delivery of the delivery pump 37 also ceases, and the existing pressure in the suction chamber 36 is slowly dissapated. The effective diameters of the slide lock 41 and of the adjusting piston 16, as well as the forces of their respective return springs 46 and 27 are adjusted relative to one another so that the lock slide 41 is always moved first by the return spring 46 from its depicted release position into the lock position indicated by the dotted lines in FIG. 1, before the adjusting piston 16 is displaced by the compression spring 27 in the "Start" direction. If the pressure falls lower still, the lock slide 41 remains in the lock position and a front transverse surface 52 of the adjusting piston 16, which faces the pressure chamber 18, engages the lock slide 41, by which means the correcting element 17 is locked in the stop-position.

Only when the electromagnet 25 of the magnetic valve 22 is again energized by the power supply during the engine starting preparation does the 2/2-way directional control valve 26 return to its conducting position as depicted in FIG. 1, in which the return duct 19 and along with it the duct 21 and pressure chamber 18 are pressure relieved to the tank 23. Because the pressure of the delivery pump 37 increases with starting of the engine, and because this pressure is carried to the work chamber 45 by the duct 47, the lock slide 41 is displaced out of its lock position into the depicted release position against the force of the return spring 46. With the pressure chamber 18 pressure relieved, the adjusting piston 16 is pressed into the depicted start position by the spring 27. Now the regulating rod 14 can be displaced into its start position by the lever 31 of the speed regulator 32.

Since the cross bore 42 is connected to the pressure chamber 18, at least when the lock slide 41 is in its lock position and the correcting element 17 is in its stop position, sealing gasket 53 is positioned as shown to seal the work chamber 45, and any leaking fuel is removed from this chamber by waste-oil bores or ducts (not shown) into the tank 23, or into another pressureless chamber of the injection pump 11. The chamber containing the spring 27 is likewise provided with waste-oil bores or ducts.

Figure 2:
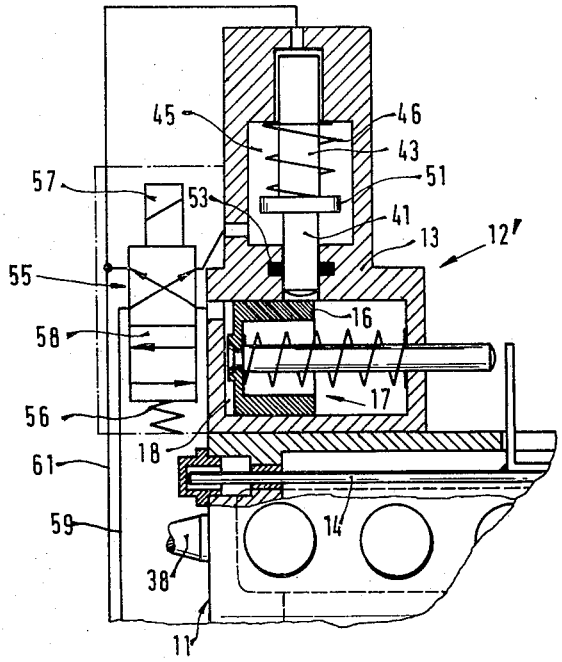
FIG. 2 illustrates a partial cross sectional view of a second preferred embodiment of the invention.

The preferred embodiment depicted in FIG. 2 differs from that according to FIG. 1 in essentially the altered functioning and positioning of the magnetic valve, here 55, of a control apparatus 12'. This magnetic valve 55, like the magnetic valve 22 if FIG. 1, is equipped with an electromagnet 57 that works against the force of a return spring 56. The electromagnet 57 actuates a 4/2-way directional control valve 58. The magnetic valve 55 works as a switch valve and connects, in the depicted release position of the lock slide 41, the work chamber 45 with a pressure duct 59 of a pressure source (not shown); and also connects the pressure chamber 18 with a return duct 61. When the electromagnet is de-energized, the return spring 56 presses the 4/2-way directional control valve 58 into its second position, at which the work chamber 45 is connected with the pressureless return duct 61 and the pressure chamber 18 is connected with the pressure duct 59. In this position, the adjusting piston 16 of the correcting element 17 is moved in the stop-position and the slide lock 41 is displaced into the lock-position by the return spring 46, thus attaining an absolutely certain roll-start lock. In this lock-position, as according to FIG. 1, the pressure line 59 can be connected to the delivery pump (not shown) of the injection pump 11 and the return duct 61 can lead back to the tank (not shown). There can, however, be any other preferred pressure source connected to the pressure duct 59, since a satisfactory functioning of the control apparatus 12' is guaranteed by the switching function independently of the amount of pressure of the pressure medium conducted to the control apparatus. Thus, for example, the pressure duct 59 can be connected to the lubricating oil circuit of the engine and the return duct can be led to the oil pan. Magnetic valve 55 can, as indicated by the dash-dot lines 62, be constructed together with the control apparatus 12' to form a single compact control device.

Figure 3:
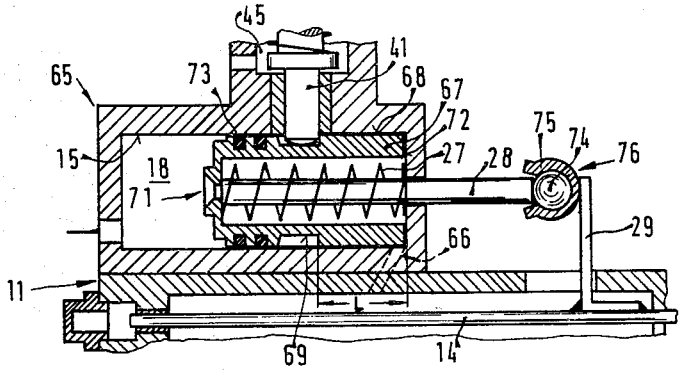
FIG. 3 is a partial cross sectional view of a third preferred embodiment of the invention illustrating essentially the area of the correcting element and the lock slide.

In FIG. 3, the part of a control apparatus 65 that differs from the other preferred embodiments is depicted. The control apparatus 65 has a slide lock 41 which operates in the same way as in the first and second preferred embodiments, with the exception, however, that it never extends into the pressure chamber 18 of the control apparatus 65. Consequently, the lock slide 41 need not be sealed by a gasket, so that the actuation force can be lowered and its function improved. Eventually filtering fuel can reach the interior of the injection pump 11 via the pressureless area of the cylinder bore 15 and a diagonally directed leak channel 66, and from there into the waste oil return. The adjusting piston 67 has a recess 69 in its surface 68, which in the present case is shaped as an annular groove, one side surface of which constitutes a support shoulder for the lock slide 41.

In contrast to FIG. 3, in FIGS. 1 and 2, the adjusting piston 67, as well as the lock slide 41, remain in the position which they attain when the engine is stopped and when the actuating rod 14 is in the stop-position. In this position, the regulating rod 28 of the adjusting piston 67 has displaced the actuating rod 14 into its stop-position by means of the bar 29, and holds it there until the lock slide 41 reaches its release position and the adjusting piston 67 can be displaced to its start-position by the compression spring 27, at which the actuating rod 14 can be brought to the start- or respectively full-load position by the speed regulator (not shown).

The correcting element 71 comprises the adjusting piston 67 and the regulating rod 28 and the surface 68 of the adjusting piston 67 has a length L between the annular groove 69 and a rear transverse surface 72 of the adjusting piston 67, so that the lock slide 41 never engages the adjusting cylinder 67 to the left of groove 69, and in case the lock slide 41 should descend prematurely, by means of a counter pressure force defined by the force of the return spring 67, it engages the surface 68 of the regulating piston 67 along the length L. Because of the chosen hydraulic medium, however, this problem practically never occurs, rather the lock slide 41 is always out of contact with the surface 68 when the engine is running.

Two piston rings are present in the surface 68 of the adjusting piston 67 between the annular groove 69 and the pressure chamber 18, which seal the pressure chamber 18 and insure that too much waste oil does not pass piston 67, and thus keep the lubricating oil within the injection pump 11 from being diluted.

While the positioning of the lock slide 41 in FIGS. 1 and 2 allows for a compact assembly of the control apparatus 12 or 12', the positioning of the lock slide 41 in FIG. 3 yields a more favorable guidance of the adjusting piston 67 and less wasted fuel.

In contrast to the embodiments of FIGS. 1 and 2, the regulating rod 28 of the correcting element 71 of the embodiment of FIG. 3 is equipped with a ball 74, which together with a rest spring 75 attached to the bar 29 of the actuating rod 14 forms part of a stop device 76. By means of the stop device 76, the actuating rod 14 is moved from its depicted stop-position into its start-position, in order to support the start procedure and above all to prevent the actuating rod 14 from sticking during a cold start.

In the place of the electromagnets 25, 57 used for the actuation of directional control valve 26 (FIG. 1) or 58 (FIG. 2), other known means of actuation can be chosen. Thus, the directional control valve 26, 58 can also be actuated by the driver via the drive connection controllable by a Bowden wire, by which means a "key-controlled" service of the diesel engines can be attained.

What is claimed and desired to be secured by Letters Patent of the United States is:

1. In a control apparatus for the fuel injection pump of a diesel engine, comprising:

a source of hydraulic pressure medium;

a corrective element actuated by the hydraulic pressure medium, said correcting element defining a longitudinal axis;

a fuel delivery adjustment element of the injection pump connectable with the correcting element for controlling the quantity of fuel delivered by the injection pump;

a lock slide arranged perpendicular to the longitudinal axis of the correcting element; and a directional control valve for controlling the flow of the hydraulic pressure medium to the correcting element, such that the correcting element is displaceable between a start position and a stop position, in reaching its stop position the correcting element displaces the fuel delivery adjustment element so as to terminate the fuel delivery of the fuel injection pump, the improvement comprising:

a spring which biases said lock slide into a position in which it prevents movement of the correcting element from its stop position to its start position;

a pressure duct;

pressure surface defining means connected to the lock slide and to the source of hydraulic pressure medium by the pressure duct, the hydraulic pressure medium from the source of hydraulic pressure acts against the pressure surface defining means to displace the lock slide against the biasing force of said spring, to thereby retract the lock slide so that the correcting element can move from its stop position to its start position; and a relief duct; and means defining a blind bore, said relief duct connecting the blind bore to the source of hydraulic pressure medium; and wherein:

(i) the pressure surface defining means comprises a piston extension of said lock slide, which together with said lock slide forms a differential piston assembly having a pressure shoulder, with the diameter of the piston extension being greater than the diameter of the lock slide; and (ii) the piston extension extends into said blind bore.

2. In the control apparatus as defined in claim 1, wherein the improvement further comprises:

a return duct; and means defining a working chamber to which the pressure duct is connected, said lock slide being mounted to extend through said working chamber; and wherein:

(i) the directional control valve comprises a 4/2-way directional control valve including an electromagnet, said 4/2-way valve being connected to both the pressure duct and the return duct; and (ii) the 4/2-way valve connects the correcting element with the return duct and the working chamber with the pressure duct when the electromagnetic is energized.

3. In the control apparatus as defined in claim 1, wherein:

(i) the correcting element includes an adjusting piston having an outer surface within which a recess is formed and a rear transverse surface, said recess being dimensioned to receive the lock slide and to serve as a support shoulder for the lock slide when the lock slide is in its position in which movement of the correcting element is prevented; and (ii) the length of said adjusting piston between the support shoulder side of said recess and said rear transverse surface is such that the lock slide, under the influence of said spring, engages the outer surface of the adjusting piston along this length when the correcting element is between its start and stop positions and the engine is stopped.

* * * * *